US005178174A

United States Patent [19]

Wu

[11] Patent Number: 5,178,174

[45] Date of Patent: Jan. 12, 1993

[54] SILENTLY SMOOTHLY OPERATING AUTOMATIC UMBRELLA CONTROLLED BY SINGLE PUSH BUTTON

[76] Inventor: Woh-Wen Wu, P. O. Box 55-1670, Taipei, Taiwan

[21] Appl. No.: 860,077

[22] Filed: Mar. 30, 1992

[51] Int. Cl.[5] ..... A45B 25/14

[52] U.S. Cl. ..... 135/22; 135/24; 135/25.4

[58] Field of Search ..... 135/22-24, 135/20.3, 25.1, 37, 38, 39, 25.4

[56] References Cited

U.S. PATENT DOCUMENTS

| | | | |
|---|---|---|---|
| 680,661 | 8/1901 | Hunt | 135/24 |
| 2,914,154 | 11/1959 | Russell | 135/20.3 X |
| 2,951,492 | 9/1960 | Small | 135/20.3 |
| 3,129,715 | 4/1964 | Militano et al. | 135/20.3 |
| 3,150,671 | 9/1964 | Frey | 135/20.3 |
| 4,319,600 | 3/1982 | Roche | 135/20.3 |
| 4,928,718 | 5/1990 | Apple | 135/20.3 X |
| 4,986,294 | 1/1991 | Wu | 135/24 X |
| 4,989,625 | 2/1991 | Wu | 135/24 X |

*Primary Examiner*—Richard E. Chilcot, Jr.
*Assistant Examiner*—Lan M. Mai

[57] ABSTRACT

An automatic umbrella includes: a central shaft having a grip formed on a lower portion of the central shaft and a controller formed in the grip for controlling an opening or closing of the umbrella, a rib assembly pivotally secured to the central shaft for supporting an umbrella cloth on the rib assembly, an extending spring retained within the central shaft for extending the shaft and the umbrella when opening the umbrella, and a plurality of retraction restoring springs secured on the rib assembly for retracting the rib assembly for closing the umbrella, in which the extending spring is jacketed on an inner sleeve fixed in an upper tubular shaft of the central shaft so as to prevent any frictional contacting of the coiled extending spring with an inside wall of the central shaft for noise prevention and for a smooth opening and closing operation of the umbrella.

5 Claims, 6 Drawing Sheets

SILENTLY SMOOTHLY OPERATING AUTOMATIC UMBRELLA CONTROLLED BY SINGLE PUSH BUTTON

BACKGROUND OF THE INVENTION

U.S. Pat. No. 5,078,165 patented on: Jan. 7, 1992 entitled: "Automatic Umbrella Opened and Closed by a Straightforward Push Button" invented by T. Z. Wu discloses a straightforward single push button 51 for controlling the opening and closing of the umbrella, which however may still have the following drawbacks:

1. The extending spring 3 is telescopically operated within the lower tubular shaft 11 and the upper tubular shaft 14 having a diameter larger than that of the lower shaft 11 so that there will have a large aperture between the coil spring 3 and an inside wall of the upper shaft 14. The spring 14 reciprocating within the aperture in the upper shaft 14 will exert noise due to a frictional contacting between the spring coils and the upper shaft 14.

2. Even a lower flange 143 is formed on the upper shaft 14 slidably held on the lower shaft 11 will bias the two helical springs 531*a* sidewardly as shown in FIG. 8 of prior art to form an aperture D between the two separated springs 531*a*, which aperture D is greater than a width W of the push button 51 so that during the depression of the push button 51 to open the umbrella, the inward movement of the button 51 will not depress the two springs 531*a* to prevent a false actuation of the closing controller 53 to ensure the locking of the locking head 536 by the retarding plate 533 of the closing controller 53.

However, if the push button 51 is further deeply depressed inwardly, the two springs 531*a* may still be touched and depressed to falsely actuate the closing controller 53 to unexpectedly accidentally close an opened umbrella.

The present inventors have found the drawbacks of the conventional prior art and invented the present automatic umbrella for improving the shortcomings of the prior art.

SUMMARY OF THE INVENTION

The object of the present invention is to provide an automatic umbrella including: a central shaft having a grip formed on a lower portion of the central shaft and a controller formed in the grip for controlling an opening or closing of the umbrella, a rib assembly pivotally secured to the central shaft for supporting an umbrella cloth on the rib assembly, an extending spring retained within the central shaft for extending the shaft and the umbrella when opening the umbrella, and a plurality of retraction restoring springs secured on the rib assembly for retracting the rib assembly for closing the umbrella, in which the extending spring is jacketed on an inner sleeve fixed in an upper tubular shaft of the central shaft so as to prevent any frictional contacting of the coiled extending spring with an inside wall of the central shaft for noise prevention and for a smooth opening and closing operation of the umbrella.

DETAILED DESCRIPTION

Figures 1, 1A, 1B, 1C, 1D:
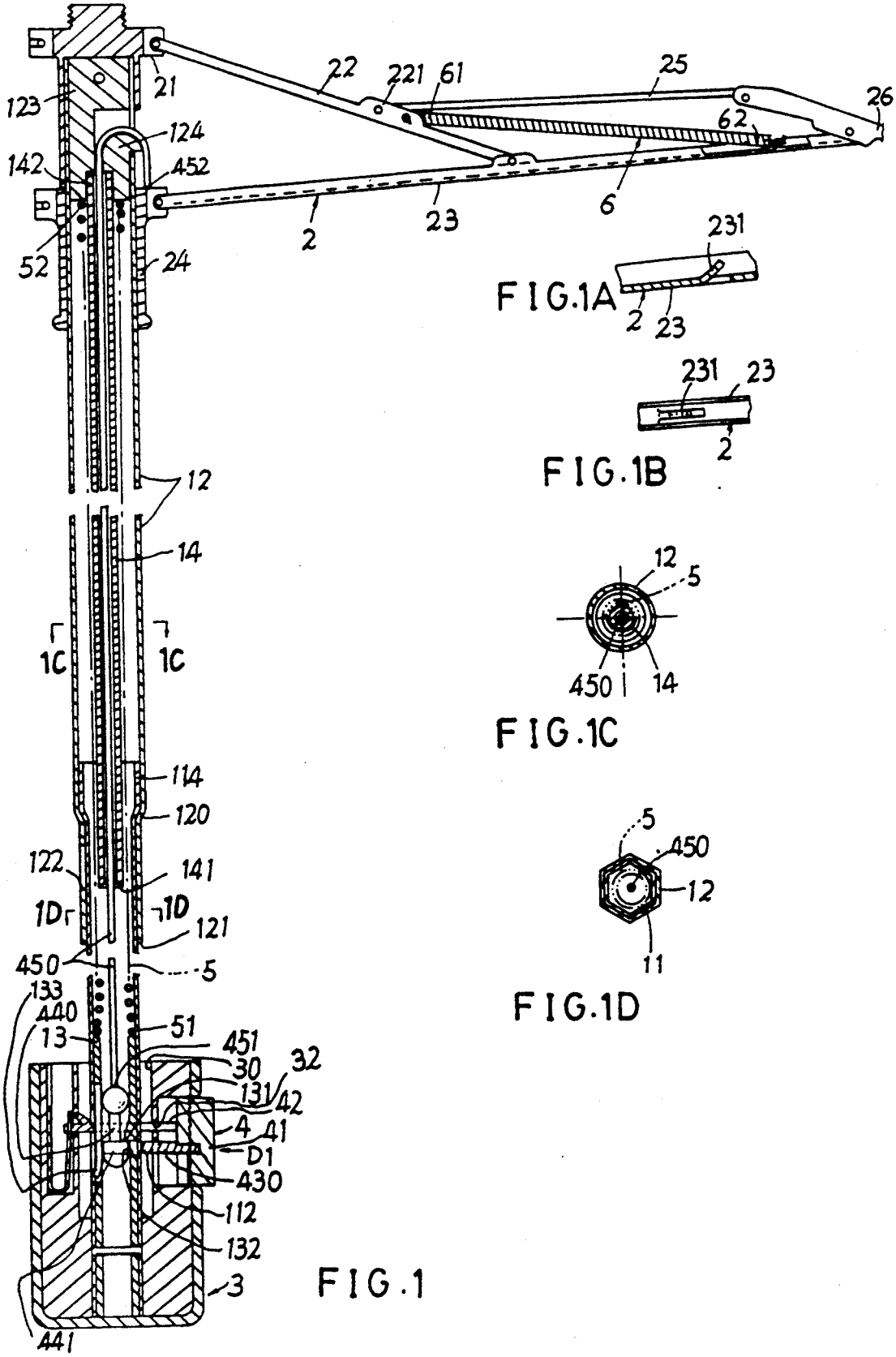
FIG. 1 is an illustration showing an opened umbrella of the present invention.
FIG. 1A is a partial sectional drawing of an outer portion of a stretcher rib of the present invention.
FIG. 1B is a top view of FIG. 1A.
FIG. 1C is a cross sectional drawing of the present invention when viewed from direction 1C—1C of FIG. 1.
FIG. 1D is a cross sectional drawing of the present invention when viewed from direction 1D—1D of FIG. 1.

As shown in FIGS. 1–6, the present invention comprises: a central shaft means 1, a rib assembly 2 for securing an umbrella cloth or canopy (not shown) on the rib assembly, a grip 3, a control means 4, an extending spring 5, and a plurality of retraction restoring springs 6.

The central shaft means 1 includes: a lower tubular shaft 11 having a lower end portion 111 of the lower tubular shaft 11 insertably fixed in the grip 3, a rod hole 112 formed in the lower end portion 111 at a first side 3*a* of the grip 3, a shaft slot 113 formed in the lower shaft 11 at a second side 3*b* of the grip opposite to the first side 3*a*, and an upper enlarged portion 114 formed on an upper end portion of the lower shaft 11; an upper tubular shaft 12 slidably jacketed on the lower tubular shaft 11 having a lower contraction portion 120 formed on a lower portion of the lower tubular shaft 11 engageable with the upper enlarged portion 114 of the lower shaft 14, an engaging hole 122 formed in the lower portion of the upper shaft 12 at the second side 3*b* of the grip 3, and an inner block 123 embedded or formed in an upper end portion of the upper shaft 12 having a sliding groove 124 recessed in the inner block 123 (in which the inner block 123 with the groove 124 may also be modified to a roller (not shown) rotatably mounted on the upper shaft 12); a lower sleeve 13 fixed in the grip 3 within the lower shaft 11 having a triangular block portion 131 formed in the lower sleeve 13 at the first side 3*a* of the grip 3 tapered downwardly inwardly towards a center of the lower shaft 11, an inner rod hole 132 formed in the lower sleeve 13 positioned below the triangular block portion 131, a resilient plate 133 cut in the lower sleeve 13 at the secured side 3*b* of the grip 3 corresponding to the triangular block portion 131 to form a slot 134 along a contour of the resilient plate 133 with the resilient plate 133 operatively extended outwardly through a shaft slot 113 formed in the lower shaft 11, and an upper sleeve end portion 135 formed on an upper end portion of the lower sleeve 13; and an inner sleeve 14 having a lower end portion 141 of the inner sleeve 14 protruding towards a coupling point with the upper enlarged portion 114 of the lower shaft 11 engaged with the lower contraction portion 120 of the upper shaft 12, and an upper end portion 142 of the inner sleeve 14 inserted in the inner block 123. The inner sleeve 14 is disposed in the extending spring 5 to allow each coiled spring ring of the extending spring 5 telescopically surrounding the inner sleeve 14 to prevent a frictional contacting between the spring 5 and an inside wall of the shafts 12, 11 for noise prevention and smooth operation of the umbrella.

The rib assembly 2 may be similar to a conventional rib assembly and includes: an upper notch 21 secured on a top portion of the upper shaft 12, a plurality of top ribs 22 pivotally secured to the upper notch 21, a plurality of stretcher ribs 23 pivotally secured to a lower runner 24 slidably held on the upper shaft 12, a plurality of outer ribs 26 each having an inner end portion of the outer rib 26 pivotally secured to an outer end portion of each stretcher rib 23 and of a connecting rib 25 of which an inner end portion of the connecting rib 25 is pivotally secured to an outer end portion of each top rib 22, and an outermost end portion of each top rib 22 pivotally secured to a middle portion of each stretcher rib 23.

Each retraction restoring spring 6 has an inner spring end portion 61 secured to a joint portion 221 pivotally connecting the top rib 22 and the connecting rib 25, and has an outer spring end portion 62 secured to a lug 231 cut out from the stretcher rib 23 and protruding upwardly outwardly from an outer end portion of the stretcher rib 23.

The extending spring 5 has its lower spring end portion 51 retained on an upper sleeve end portion 135 of the lower sleeve 13 and has an upper spring end portion 52 retained on the inner block 123 formed on an upper portion of the upper shaft 12.

The lower shaft 11 has a cross section of hexagonal shape for storing the extending spring 5 in the shaft 11, whereas the upper shaft 12 has a cross section of circular shape, but with the lower end portion 121 having a cross section of hexagonal shape to be engageable with the lower shaft 11.

The control means 4 includes: a push button 41, an opening controller 42, and a closing controller 43.

Figure 4:
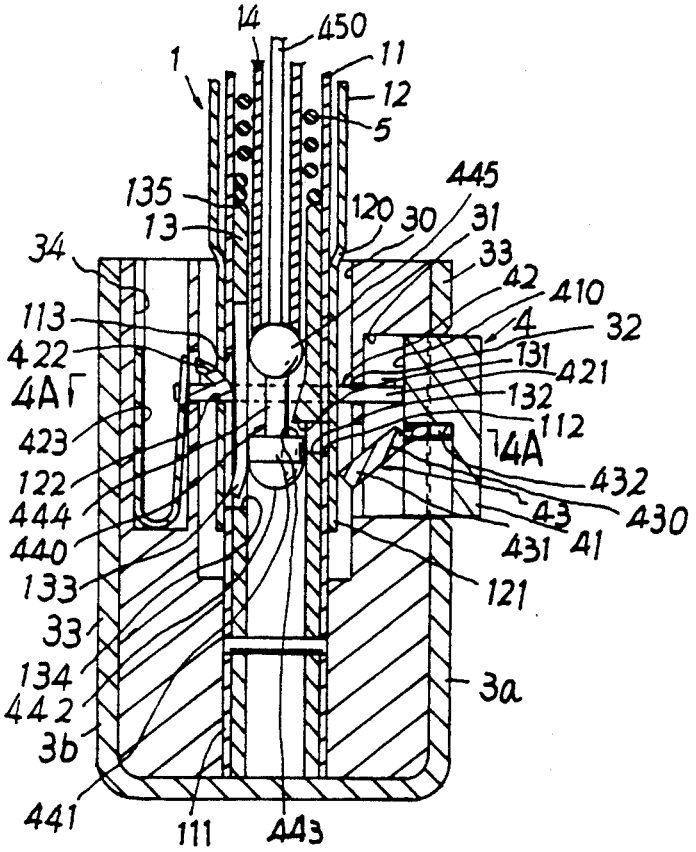
FIG. 4 is a sectional drawing of the grip and a control means of the present invention.
Figure 4A:
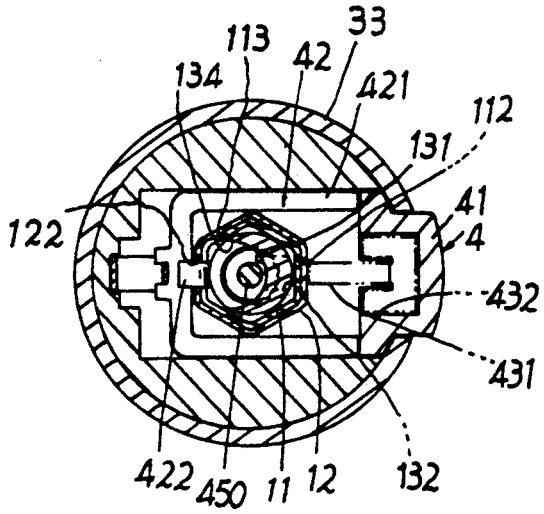
FIG. 4A is a cross sectional drawing of the present invention when viewed from direction 4A—4A of FIG. 4.

The push button 41 includes: a shoulder portion 413 slidably held in a button hole 31 formed in the grip 3 at the first side 3*a* of the grip 3, and limited by an outer jacket 33 surrounding the grip 3 as shown in FIG. 4A, a pushing rod socket 411 recessed in an inside button surface 410 of the push button 41, and a pushing rod groove 412 recessed in the inside button surface 410 and protruding downwardly from the pushing rod socket 411.

The opening controller 42 includes: a pair of bifurcated members 421 slidably held in a middle transverse hole 32 formed in a central portion of the grip 3, a wedge portion 422 tapered downwardly inwardly towards a center of the central shaft means 1 and secured to an inner portion of each bifurcated member 421, and a controller restoring spring 423 held in a spring socket 34 formed in the grip 3 at the second side 3*b* of the grip 3 normally urging the bifurcated members 421 outwardly to touch the inside button surface 410 of the push button to protrude the push button 41 outwardly ready for depression operation. The wedge portion 422 slidably passes through the slot 113 formed in the lower shaft 11 and the transverse hole 32 of the grip 3 for locking the engaging hole 122 of the upper shaft 12 when closing the umbrella as shown in FIG. 4.

Figure 2:
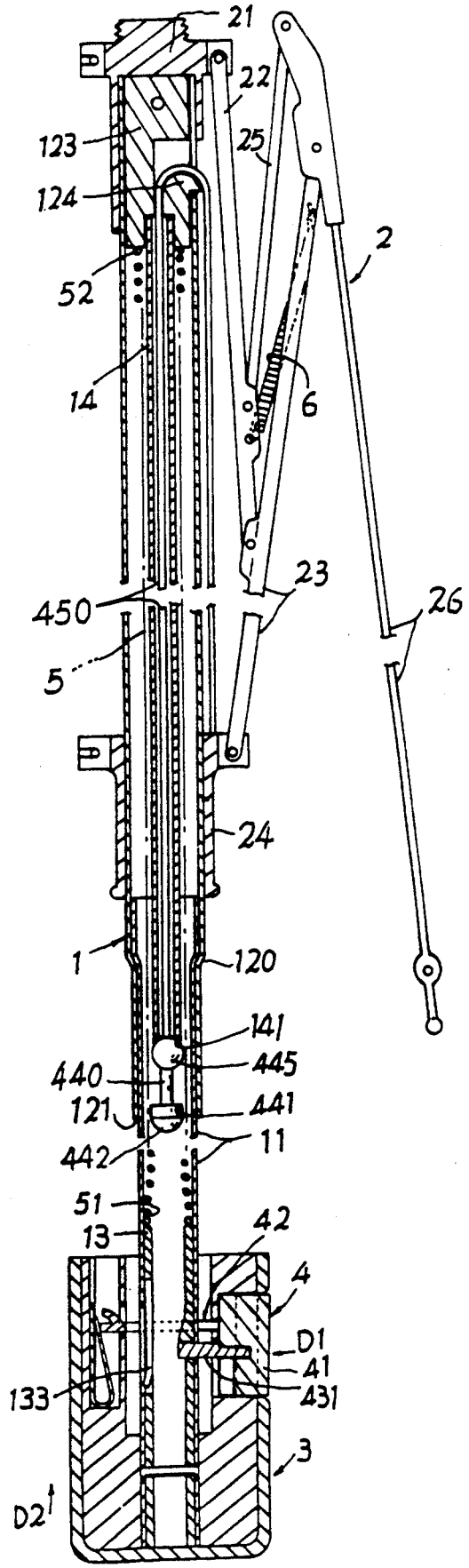
FIG. 2 is an illustration showing a closed umbrella of the present invention.
Figure 7:
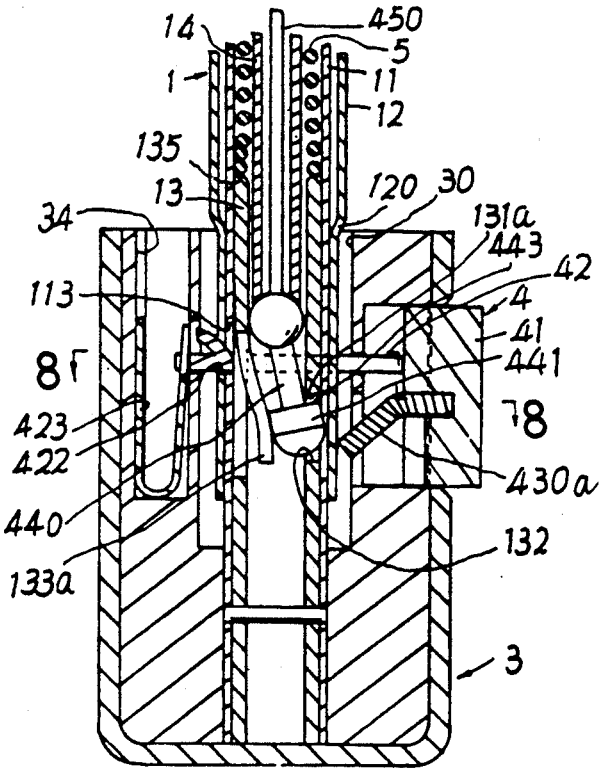
FIG. 7 shows another preferred embodiment of the grip and control means of the present invention.
Figure 5:
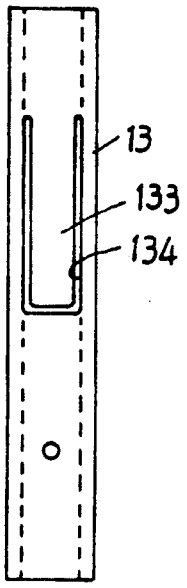
FIG. 5 is a side view of a lower sleeve of the present invention.
Figure 8:
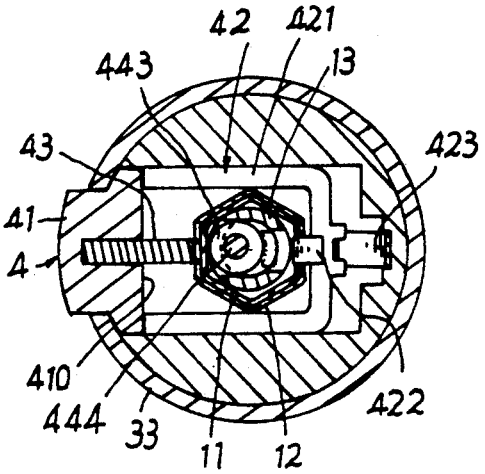
FIG. 8 is a cross sectional drawing of the present invention when viewed from direction 8—8 of FIG. 7.
Figure 6:
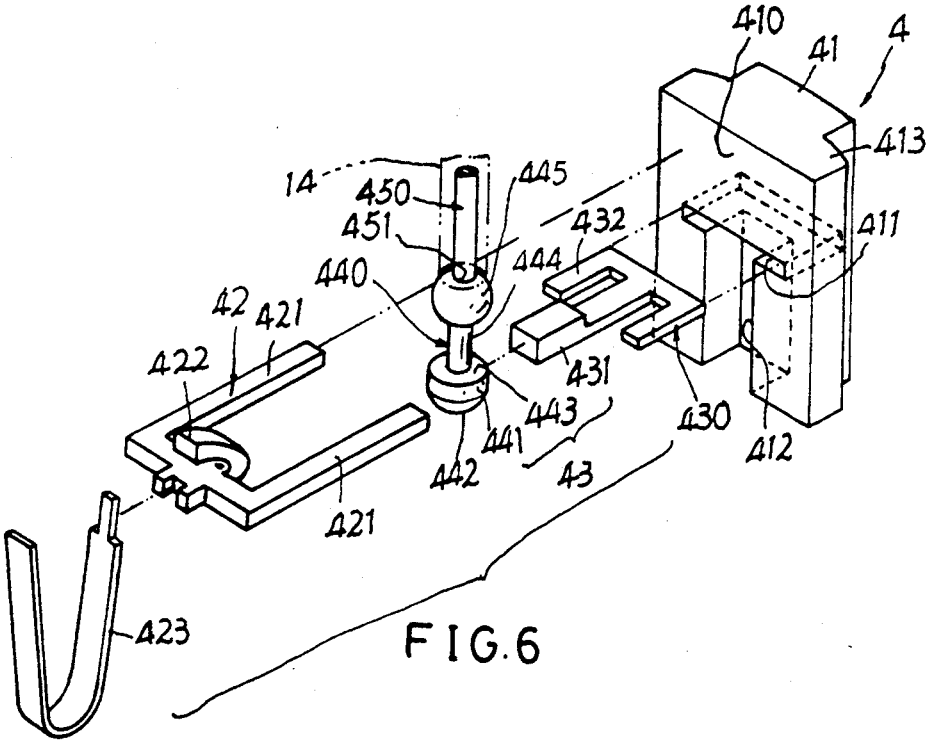
FIG. 6 is a perspective view of the control means of the present invention.
Figure 9:
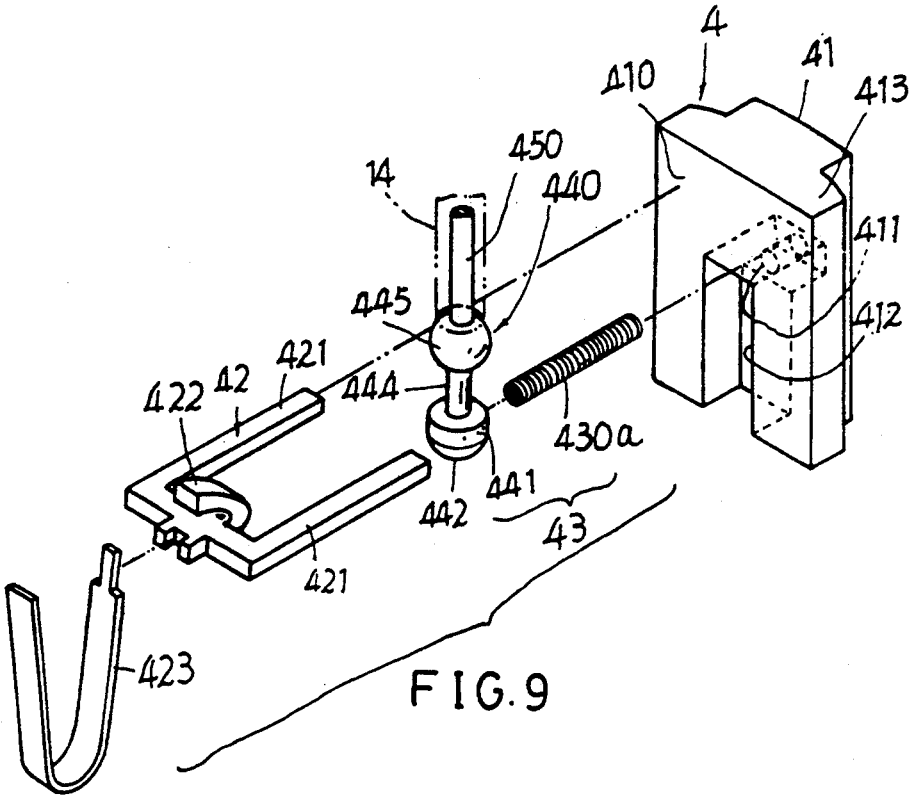
FIG. 9 is a perspective view of the present invention as shown in FIG. 7.

The closing controller 43 includes: an elastic pushing rod 430 made of elastic plate or elastomer rod or a helical spring 430*a* as shown in FIGS. 7–9, having a pushing rod portion 431 normally horizontally protruding inwardly from a holding portion 432, which is embedded in the pushing rod socket 411 recessed in the push button 41, to be operatively depressed and bent downwardly by the lower end portion 121 of the upper shaft 12 when closing the umbrella for retracting the upper shaft 12 into the central hole 30 of the grip 3 as shown in FIG. 4; a locking head means 440 having a locking head portion 441 formed with an arcuate bottom portion 442 on a bottom portion of the locking head portion 441 and a locking shoulder portion 443 on an upper portion of the locking head portion 441, and a universal ball 445 secured with the locking head portion 441 with a neck portion 444 between the ball 445 and the locking head portion 441 universally held on the lower end portion 141 of the inner sleeve 14 when closing the umbrella; and a rope 450 having a lower rope end portion 451 secured with the universal ball 445 of the locking head means 440 and having an upper rope end portion 452 secured to the lower runner 24 by passing the rope 450 through the inner sleeve 14 and winding the rope 450 on the sliding groove 124 formed on the inner block 123. The locking head portion 441 provided with the arcuate bottom portion 442 when lowered in the lower sleeve 13 when folding the umbrella will be biased by the triangular block portion 131 (serving as a retarding block portion) to push the resilient plate 133 outwardly from a center of the shaft means 1 until being engaged and locked by the triangular block portion 131; or the locking head portion 441 may be disengaged from the triangular block portion 131 when thrusted by the pushing rod portion 431 of the elastic pushing rod 430 as shown in FIG. 2.

The triangular block portion 131 may be modified as a retarding block portion 131*a* directly recessed in the lower sleeve 13, and the resilient plate 133 is normally inclined downwardly inwardly towards a center of the central shaft means 1 as shown in FIG. 7 so that when lowering the locking head portion 441, the head portion 141 will be biased towards a center of the shaft means 1 (FIG. 7) to be engaged with and locked by the retarding block portion 131*a* formed in the lower sleeve 13.

Figure 3:
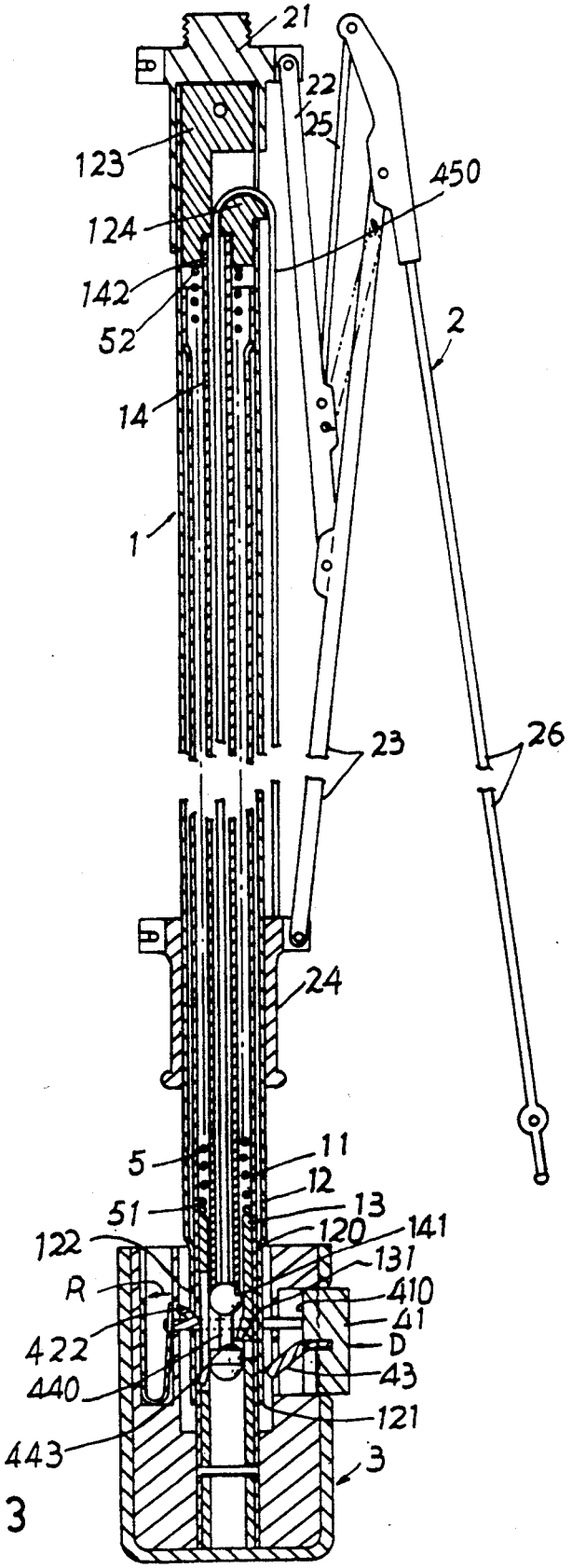
FIG. 3 shows a folded umbrella when compressing the grip of the present invention as shown in FIG. 2.

When it is intended to open the umbrella of the present invention from a closed state as shown in FIGS. 3, 4, the push button 41 is depressed in direction D to retract the bifurcated members 421 and the wedge portion 422 (direction R) to disengage the engaging hole 122 of the upper shaft 12 so that the extending spring 5 will be extended to urge the upper shaft 12 upwardly to be positioned above the lower shaft 11 and the rib assembly 2 and the umbrella cloth will also be extended to open the umbrella as shown in FIG. 1. Meanwhile, the lower runner 24 is also raised upwardly to pull and tension the rope 450 secured between the runner 24 and the locking head means 440 until the locking head portion 441 is locked by the retarding or triangular block portion 131. Each retraction restoring spring 6 is extended and tensioned to restore its elastic energy when opening the umbrella by the extending spring 5 to be ready for lowering the runner 24 for closing the umbrella. However, the lowering of the runner 24 by each retraction restoring spring 6 will pull the rope 450 which is locked by the locking head portion 441 engaged by the block portion 131 and therefore, the retraction restoring spring 6 can not be effected to close the umbrella which is opened by the extending spring 5 for extending the tubular shafts 12, 11, the ribs 2 and the umbrella cloth.

During the opening operation of the umbrella, a user's finger has depressed the push button 41 in direction D so that the pushing rod portion 431 is operatively bent downwardly without falsely depressing the closing controller 43, thereby preventing an unexpected accidental closing of an opened umbrella.

When closing the umbrella from an opened state as shown in FIG. 1, the push button 41 is depressed in direction D1 (FIGS. 1, 2) to allow the pushing rod portion 431 to disengage the locking head portion 441 from the triangular block portion 131 so that the retraction restoring springs 6 will restore to lower the runner 24 to retract the ribs 2 for closing the umbrella as shown in FIG. 2.

Upon a depression in direction D2 of FIG. 2 to compress the spring 5 and to allow the wedge portion 422 of the opening controller 42 to engage the engaging hole 122 of the upper shaft 12, the tubular shafts 12, 11 will then be retracted and folded to be as shown in FIG. 3, in which the locking head portion 441 is also lowered to be positioned below the triangular block portion 131 for facing the rod holes 112, 132 formed in the lower shaft 11 and the lower sleeve 13, ready for a next depression by the pushing rod portion 431 of the closing controller 43.

The present invention is superior to a conventional umbrella with automatically opening and closing function with the following advantages:

1. Since the inner sleeve 14 is jacketed in the extending spring 5 to prevent a twisting or bending of the spring coils of the spring 5 in the aperture of the shaft 1, a noise caused by frictional contacting between the spring 5 and the shaft 12 will then be prevented.

2. The control means 4 can be operated precisely for preventing an unexpected false operation, thereby increasing the reliability for opening and closing the umbrella.

3. The rope 450 is uniquely provided in the shaft 1 without being intermediately connected by any drag rod or coupling for simplifying the production of the umbrella.

4. The structure and mechanism of the control means is simplified for reducing production cost and minimizing assembly and maintenance problems.

We claim:

1. An automatic umbrella comprising:

a central shaft means having an upper tubular shaft slidably telescopically engageable with a lower tubular shaft and extendibly positioned above said lower tubular shaft, said lower tubular shaft secured on a grip;

a rib assembly having at least a top rib pivotally secured to an upper notch fixed on a top portion of said upper shaft, and a stretcher rib pivotally secured with said top rib and pivotally secured to a lower runner slidably held on said central shaft means;

an extending spring retained in between said upper shaft and said lower shaft for operatively opening the umbrella;

an inner sleeve fixed in said upper shaft and inserted in said extending spring with each coiled spring ring of said extending spring slidably surrounding said inner sleeve for preventing noise caused by a frictional contacting between said extending spring and an inside wall of said upper shaft of said shaft means;

a plurality of retraction restoring springs each retained on said rib assembly for operatively closing the umbrella from an opened state of the umbrella; and a control means including a push button slidably held in said grip, an opening controller for operatively opening the umbrella from its closed state, and a closing controller for operatively closing the umbrella from its opened state;

said central shaft means including: said lower tubular shaft having a lower end portion of the lower tubular shaft insertably fixed in the grip, a rod hole formed in the lower end portion at a first side of the grip, a shaft slot formed in the lower shaft at a second side opposite to the first side, and an upper enlarged portion formed on an upper end portion of the lower shaft; said upper tubular shaft slidably jacketed on the lower tubular shaft having a lower contraction portion formed on a lower portion and engageable with the upper enlarged portion of the lower shaft, an engaging hole formed in the lower portion of the upper shaft at the second side of the grip, and an inner block formed in an upper end portion of the upper shaft having a sliding groove recessed in the inner block; a lower sleeve fixed in the grip within the lower shaft having a triangular block portion formed in the lower sleeve at the first side of the grip, an inner rod hole formed in the lower sleeve positioned below the triangular block portion, a resilient plate cut in the lower sleeve at the second side of the grip corresponding to the triangular block portion to form a slot along a contour of the resilient plate, and an upper sleeve end portion formed on an upper end portion of the lower sleeve; and said inner sleeve having a lower end portion of the inner sleeve protruding towards a coupling portion with the upper enlarged portion of the lower shaft engaged with the lower contraction portion of the upper shaft, and an upper end portion of the inner sleeve inserted in the inner block; said inner sleeve disposed in the extending spring to allow each coiled spring ring of the extending spring telescopically surrounding the inner sleeve to prevent a frictional contacting between the extending spring and an inside wall of the upper and lower shafts for noise prevention and smooth operation of the umbrella.

2. An automatic umbrella according to claim 1, wherein said control means includes: said push button having a shoulder portion slidably held in a button hole formed in the grip at a first side of the grip, and limited by an outer jacket surrounding the grip, a pushing rod socket recessed in an inside button surface of the push button, and a pushing rod groove recessed in the inside button surface and protruding downwardly from the pushing rod socket;

said opening controller including a pair of bifurcated members slidably held in a middle transverse hole formed in a central portion of the grip, a wedge portion tapered downwardly inwardly toward a center of the central shaft means and secured to an inner portion of each bifurcated member, and a controller restoring spring held in a spring socket formed in the grip at a second side of the grip normally urging the bifurcated members outwardly to touch the inside button surface of the push button to protrude the push button outwardly ready for depression operation, said wedge portion slidably passing through a slot formed in the lower shaft and the transverse hole of the grip for engageably locking an engaging hole of the upper shaft of the shaft means when closing the umbrella; and said closing controller including an elastic pushing rod having a pushing rod portion normally horizontally protruding inwardly from a holding portion, which is embedded in the pushing rod socket recessed in the push button, to be operatively depressed and bent downwardly by a lower end portion of the upper shaft of the shaft means when closing the umbrella for retracting the upper shaft into a central hole of the grip; a locking head means having a locking head portion formed with an arcuate bottom portion on a bottom portion of the locking head portion and a locking shoulder portion on an upper portion of the locking head portion, and a universal ball secured with the locking head portion with a neck portion between the ball and the locking head portion universally held on a lower end portion of the inner sleeve when closing the umbrella; and a rope having a lower rope end portion secured with the universal ball of the locking head means and having an upper rope end portion secured to a lower runner of said rib assembly by passing the rope through the inner sleeve and winding the rope on a sliding groove formed on an inner block formed on the upper shaft.

3. An automatic umbrella according to claim 2, wherein said elastic pushing rod of said push button is made as a helical spring held in said push button.

4. An automatic umbrella according to claim 2, wherein said locking head portion is operatively engaged with a triangular block portion formed in a lower sleeve fixed in said grip, said triangular block portion tapered downwardly inwardly toward a center of said central shaft means, and said lower sleeve cut to form a resilient plate corresponding to said triangular block portion, whereby upon a lowering of said locking head portion when folding the umbrella, said locking head portion is biased outwardly by said triangular block portion to push said resilient plate outwardly until being engaged and locked by said triangular block portion.

5. An automatic umbrella according to claim 2, wherein said locking head portion is operatively engaged with a triangular block portion directly recessed in a lower sleeve fixed in said grip, and said lower sleeve cut to form a resilient plate corresponding to said triangular block portion and normally inclined inwardly downwardly toward a center of said central shaft means, whereby upon a lowering of said locking head portion when folding the umbrella, said locking head portion is inwardly biased by said resiliently plate to be engaged and locked by said triangular block portion formed in said lower sleeve.

* * * * *